US010317828B2

(12) United States Patent
Naitoh et al.

(10) Patent No.: US 10,317,828 B2
(45) Date of Patent: Jun. 11, 2019

(54) FIXING DEVICE INCLUDING A NIP FORMATION PAD WITH A POROUS STRUCTURE, AND IMAGE FORMING APPARATUS INCORPORATING SAME

(71) Applicant: Ricoh Company, Ltd., Ohta-ku (JP)

(72) Inventors: Yutaka Naitoh, Kanagawa (JP); Seiji Saitoh, Kanagawa (JP); Yasuharu Kawarasaki, Tochigi (JP); Kenta Kashiwagi, Kanagawa (JP); Masahiro Samei, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/919,524

(22) Filed: Mar. 13, 2018

(65) Prior Publication Data

US 2018/0267449 A1 Sep. 20, 2018

(30) Foreign Application Priority Data

Mar. 17, 2017 (JP) ..... 2017-052669

(51) Int. Cl.
*G03G 15/20* (2006.01)
*G03G 15/01* (2006.01)

(52) U.S. Cl.
CPC ..... *G03G 15/206* (2013.01); *G03G 15/2025* (2013.01); *G03G 15/0105* (2013.01);
(Continued)

(58) Field of Classification Search
CPC ..... G03G 15/2053; G03G 15/2057; G03G 15/2075
See application file for complete search history.

(56) References Cited

U.S. PATENT DOCUMENTS 7,493,074 B2 * 2/2009 Komuro ..... G03G 15/206 399/328
2009/0010686 A1 * 1/2009 Matsumoto ..... G03G 15/2057 399/324

(Continued)

FOREIGN PATENT DOCUMENTS

JP 2001034093 A * 2/2001
JP 2014-153403 8/2014

(Continued)

*Primary Examiner* — Benjamin R Schmitt
*Assistant Examiner* — Milton Gonzalez
(74) *Attorney, Agent, or Firm* — Xsensus LLP

(57) ABSTRACT

A fixing device includes a rotator, an endless belt, and a nip formation pad. The endless belt contacts the rotator and rotates in a direction of rotation. The nip formation pad contacts an inner circumferential surface of the endless belt to form a fixing nip between the endless belt and the rotator that presses the endless belt against the nip formation pad. The nip formation pad includes a slide layer, a base layer, and a lubricant holding layer. The slide layer contacts the endless belt. The base layer is disposed away from the endless belt. The lubricant holding layer is interposed between the slide layer and the base layer to hold a lubricant inside the lubricant holding layer and supply the lubricant to the slide layer. The slide layer has a porous structure including a plurality of through holes in a thickness direction of the slide layer.

14 Claims, 4 Drawing Sheets

(52) U.S. Cl.
CPC ..... *G03G 2215/2009* (2013.01); *G03G 2215/2048* (2013.01); *G03G 2215/2074* (2013.01)

(56) References Cited

U.S. PATENT DOCUMENTS

| | | | | |
|---|---|---|---|---|
| 2009/0162772 | A1 | 6/2009 | Fuwa et al. | |
| 2013/0266354 | A1* | 10/2013 | Nishida | G03G 15/2089 399/329 |
| 2013/0266355 | A1* | 10/2013 | Yoshiura | G03G 15/2017 399/329 |
| 2014/0079453 | A1* | 3/2014 | Arai | G03G 15/20 399/329 |
| 2014/0233978 | A1* | 8/2014 | Nakai | G03G 15/657 399/96 |
| 2014/0241766 | A1 | 8/2014 | Ishii et al. | |
| 2016/0209789 | A1 | 7/2016 | Nozawa et al. | |
| 2016/0274519 | A1* | 9/2016 | Lim | G03G 15/2053 |
| 2016/0378028 | A1 | 12/2016 | Fujiwara et al. | |
| 2016/0378032 | A1 | 12/2016 | Saitoh | |
| 2017/0003633 | A1 | 1/2017 | Hase et al. | |
| 2017/0003634 | A1 | 1/2017 | Samei et al. | |
| 2017/0045850 | A1 | 2/2017 | Fujii et al. | |
| 2017/0176905 | A1* | 6/2017 | Suzuki | G03G 15/2053 |
| 2017/0235259 | A1 | 8/2017 | Saitoh et al. | |
| 2017/0269522 | A1 | 9/2017 | Kubota et al. | |
| 2017/0269524 | A1 | 9/2017 | Yamaji et al. | |
| 2017/0269525 | A1 | 9/2017 | Okamoto et al. | |
| 2017/0269526 | A1 | 9/2017 | Yuasa et al. | |
| 2017/0357197 | A1 | 12/2017 | Okamoto et al. | |

FOREIGN PATENT DOCUMENTS

| | | |
|---|---|---|
| JP | 2014-186303 | 10/2014 |
| JP | 2014186315 A * | 10/2014 |
| JP | 2015-169810 | 9/2015 |

* cited by examiner

FIXING DEVICE INCLUDING A NIP FORMATION PAD WITH A POROUS STRUCTURE, AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2017-052669, filed on Mar. 17, 2017, in the Japan Patent Office, the entire disclosure of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image on a recording medium, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

SUMMARY

In one embodiment of the present disclosure, a novel fixing device includes a rotator, an endless belt, and a nip formation pad. The rotator is rotatable in a direction of rotation. The endless belt contacts the rotator and rotates in a direction of rotation. The nip formation pad contacts an inner circumferential surface of the endless belt to form a fixing nip between the endless belt and the rotator that presses the endless belt against the nip formation pad. The nip formation pad includes a slide layer, a base layer, and a lubricant holding layer. The slide layer contacts the endless belt. The base layer is disposed away from the endless belt. The lubricant holding layer is interposed between the slide layer and the base layer to hold a lubricant inside the lubricant holding layer and supply the lubricant to the slide layer. The slide layer has a porous structure including a plurality of through holes in a thickness direction of the slide layer.

Also described is a novel image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
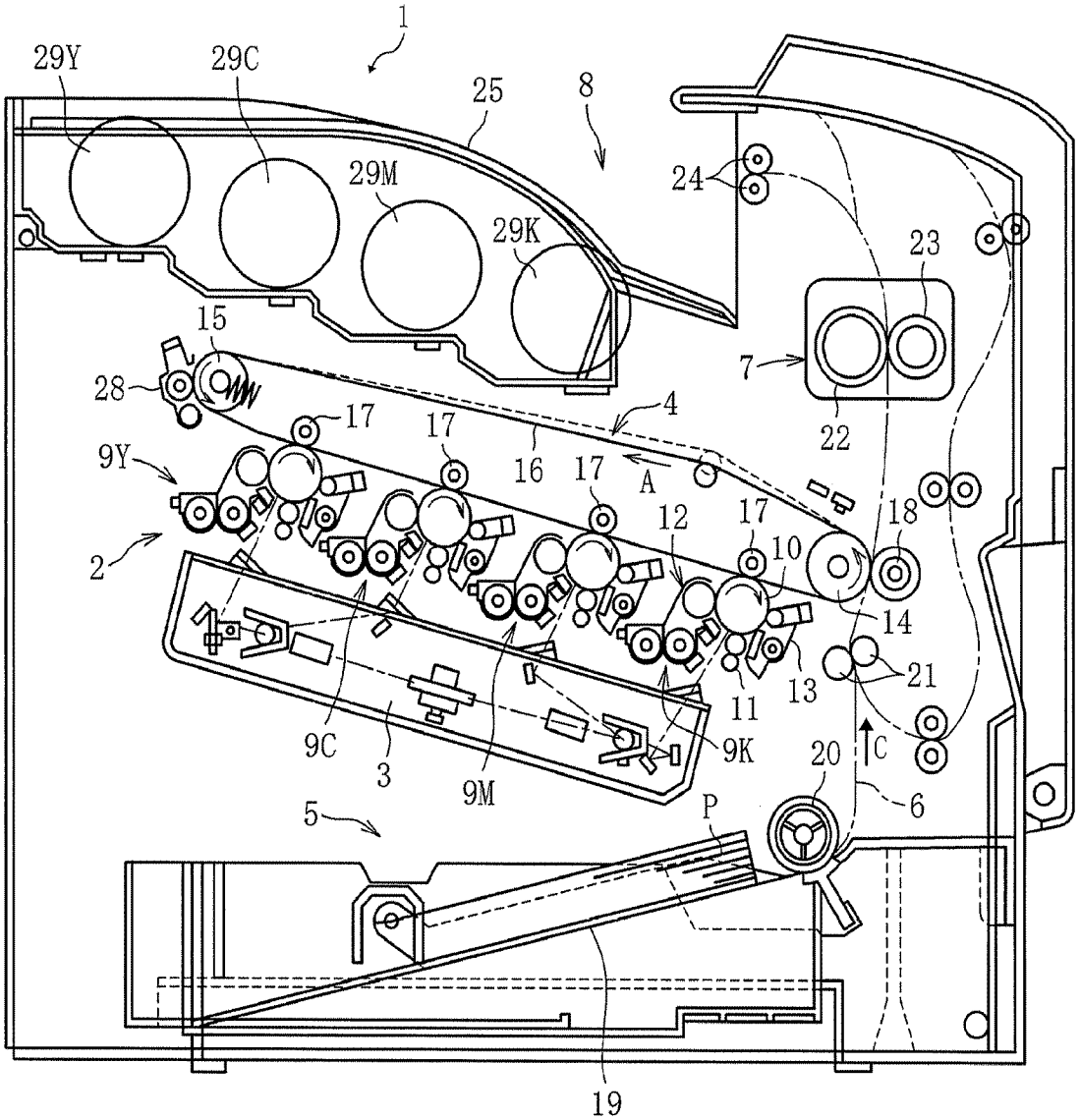
FIG. 1 is a schematic sectional view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors yellow, cyan, magenta, and black, respectively. To simplify the description, these suffixes are omitted unless necessary.

Referring now to the drawings, wherein like reference numerals designate identical or corresponding parts throughout the several views, embodiments of the present disclosure are described below.

Initially with reference to FIG. 1, a description is given of an overall configuration of an image forming apparatus 1 according to an embodiment of the present disclosure.

FIG. 1 is a schematic sectional view of the image forming apparatus 1.

The image forming apparatus 1 may be, e.g., a copier, a facsimile machine, a printer, a multifunction peripheral (MFP) having at least two of copying, printing, scanning, facsimile, and plotter functions. In the present embodiment, the image forming apparatus 1 is a color image forming apparatus that forms color and monochrome images on recording media by electrophotography.

As illustrated in FIG. 1, the image forming apparatus 1 includes an image forming device 2 disposed in a center portion of the image forming apparatus 1. The image forming device 2 includes four removable process units 9Y, 9C, 9M, and 9K. The process units 9Y, 9C, 9M, and 9K have identical configurations, except that the process units 9Y, 9C, 9M, and 9K contain developers in different colors, that is, yellow (Y), cyan (C), magenta (M), and black (K) corresponding to color-separation components of a color image.

Each of the process units 9Y, 9C, 9M, and 9K includes, e.g., a photoconductive drum 10, a charging roller 11, a developing device 12, and a cleaner 13. The photoconductive drum 10 is a drum-shaped photoconductor serving as an image bearer. The charging roller 11 serves as a charger. The photoconductive drum 10 is a drum-shaped rotator that bears toner as a developer of a toner image on an outer circumferential surface of the photoconductive drum 10. The charging roller 11 uniformly charges the outer circumferential surface of the photoconductive drum 10. The developing device 12 includes a drum-shaped developing roller that supplies toner to the outer circumferential surface of the photoconductive drum 10. The cleaner 13 removes residual toner from the outer circumferential surface of the photoconductive drum 10. In this case, the residual toner is toner that has failed to be transferred from the photoconductive drum 10 onto an intermediate transfer belt 16, and therefore that remains on the photoconductive drum 10.

Below the process units 9Y, 9C, 9M, and 9K is an exposure device 3. The exposure device 3 emits a laser beam onto the photoconductive drum 10 according to image data.

Above the image forming device 2 is a transfer device 4. The transfer device 4 includes, e.g., a drive roller 14, a driven roller 15, the intermediate transfer belt 16, and four primary transfer rollers 17. The intermediate transfer belt 16 is an endless belt rotatably entrained around the drive roller 14, the driven roller 15, and the like. Each of the four primary transfer rollers 17 is disposed opposite the corresponding photoconductive drum 10 via the intermediate transfer belt 16. At the position opposite the photoconductive drum 10, each of the four primary transfer rollers 17 presses an inner circumferential surface of the intermediate transfer belt 16 against the corresponding photoconductive drum 10 to form an area of contact, herein referred to as a primary transfer nip, between the intermediate transfer belt 16 and the photoconductive drum 10.

A secondary transfer roller 18 is disposed opposite the drive roller 14 via the intermediate transfer belt 16. The secondary transfer roller 18 is pressed against an outer circumferential surface of the intermediate transfer belt 16 to form an area of contact, herein referred to as a secondary transfer nip, between the secondary transfer roller 18 and the intermediate transfer belt 16.

As described above, each of the four primary transfer rollers 17 sandwich the intermediate transfer belt 16 together with the corresponding photoconductive drum 10, thereby forming the primary transfer nip between the intermediate transfer belt 16 and the photoconductive drum 10. The primary transfer rollers 17 are coupled to a power supply. The power supply applies at least one of a predetermined direct current (DC) voltage and a predetermined alternating current (AC) voltage to the primary transfer rollers 17.

As described above, the secondary transfer roller 18 sandwiches the intermediate transfer belt 16 together with the drive roller 14, thereby forming the secondary transfer nip between the secondary transfer roller 18 and the intermediate transfer belt 16. Similar to the primary transfer rollers 17, the secondary transfer roller 18 is coupled to the power supply. The power supply applies at least one of a predetermined direct current (DC) voltage and a predetermined alternating current (AC) voltage to the secondary transfer roller 18.

A belt cleaner 28 includes a cleaning brush and a cleaning blade disposed to contact the outer circumferential surface of the intermediate transfer belt 16. The belt cleaner 28 removes residual toner from the intermediate transfer belt 16 as a waste toner. In this case, the residual toner is toner that has failed to be transferred from the intermediate transfer belt 16 onto a sheet P, and therefore that remains on the intermediate transfer belt 16. In short, the belt cleaner 28 collects the waste toner. A waste toner conveyance tube extends from the belt cleaner 28 to an inlet of a waste toner container. The waste toner collected by the belt cleaner 28 passes through the waste toner conveyance tube and contained in the waste toner container.

The sheet feeder 5 is positioned in a lower portion of the image forming apparatus 1. The sheet feeder 5 includes, e.g., a sheet tray 19 and a sheet feeding roller 20. Sheets P, serving as recording media, can be loaded onto the sheet tray 19. The sheet feeding roller 20 picks up and feeds the sheets P one by one from the sheet tray 19 to a conveyance passage 6, which is defined by some internal components of the image forming apparatus 1.

In the present embodiment, the sheets P are plain paper. Alternatively, the sheet P may be thick paper, postcards, envelopes, thin paper, coated paper, art paper, tracing paper, overhead projector (OHP) transparencies, plastic films, prepreg, copper foil, and the like.

The sheets P are conveyed along the conveyance passage 6 from the sheet feeder 5 toward a sheet ejector 8. Conveyance roller pairs including a registration roller pair 21 are disposed along the conveyance passage 6.

The fixing device 7 includes, e.g., a fixing belt 22 serving as a fixing rotator and a pressure roller 23 serving as a pressure rotator. The fixing belt 22 is an endless belt heated by a heater. The pressure roller 23 presses against the fixing belt 22.

The sheet ejector 8 is disposed in an extreme downstream part of the conveyance passage 6 in a direction of conveyance of the sheet P, hereinafter referred to as a sheet conveyance direction C. The sheet ejector 8 includes an ejection roller pair 24 and an output tray 25. The ejection roller pair 24 ejects the sheets P onto the output tray 25 disposed atop a housing of the image forming apparatus 1. Thus, the sheets P lie stacked on the output tray 25.

In an upper portion of the image forming apparatus 1, removable toner bottles 29Y, 29C, 29M, and 29K are disposed. The toner bottles 29Y, 29C, 29M, and 29K are filled with fresh toner of yellow, cyan, magenta, and black, respectively. A toner supply tube is interposed between each of the toner bottles 29Y, 29C, 29M, and 29K and the corresponding developing device 12. The fresh toner is supplied from each of the toner bottles 29Y, 29C, 29M, and 29K to the corresponding developing device 12 through the toner supply tube.

To provide a fuller understanding of the embodiments of the present disclosure, a description is now given of an image forming operation of the image forming apparatus 1 with continued reference to FIG. 1.

As the image forming apparatus 1 starts the image forming operation in response to a print job assigned thereto, the exposure device 3 emits laser beams to the outer circumferential surface of the photoconductive drums 10 of the respective process units 9Y, 9C, 9M, and 9K according to image data, thus forming electrostatic latent images on the photoconductive drums 10. The image data used to expose each of the photoconductive drums 10 is single color image data produced by decomposing a desired full color image into yellow, cyan, magenta, and black image data. For example, according to the yellow image data, the photoconductive drum 10 of the process unit 9Y is irradiated with a laser beam. Thus, the electrostatic latent image is formed on the photoconductive drum 10. Then, the developing device 12 supplies toner to the photoconductive drum 10. Specifically, the drum-shaped developing roller supplies toner stored in the developing device 12 to the outer circumferential surface of the photoconductive drum 10, rendering the electrostatic latent image visible as a toner image or developer image on the photoconductive drum 10. In short, the developing device 12 develops the electrostatic latent image into a visible toner image.

In the transfer device 4, a driver drives and rotates the drive roller 14, thereby rotating the intermediate transfer belt 16 in a counterclockwise direction, herein referred to as a belt rotation direction A, in FIG. 1. As described above, the power supply applies voltage to the primary transfer rollers 17. Specifically, the primary transfer rollers 17 are supplied with a constant voltage or a constant current control voltage having a polarity opposite a polarity of the charged toner. Accordingly, transfer electric fields are generated at the primary transfer nips. The transfer electric fields thus generated transfer yellow, cyan, magenta, and black toner images from the respective photoconductive drums 10 onto the intermediate transfer belt 16 such that the yellow, cyan, magenta, and black toner images are sequentially superimposed one atop another on the intermediate transfer belt 16. Thus, a composite, full color toner image is formed on the intermediate transfer belt 16.

In the meantime, in the lower portion of the image forming apparatus 1, the sheet feeding roller 20 of the sheet feeder 5 is rotated to feed a sheet P from the sheet tray 19 toward the registration roller pair 21 along the conveyance passage 6. Activation of the registration roller pair 21 is timed to send out the sheet P toward the secondary transfer nip between the secondary transfer roller 18 and the intermediate transfer belt 16 such that the full color toner image on the intermediate transfer belt 16 meets the sheet P at the secondary transfer nip. As described above, the power supply applies voltage to the secondary transfer roller 18. Specifically, the secondary transfer roller 18 is supplied with a transfer voltage having a polarity opposite a polarity of charged toner of the full color toner image on the intermediate transfer belt 16. Accordingly, a transfer electric field is generated at the secondary transfer nip. The transfer electric field thus generated transfers the full color toner image from the intermediate transfer belt 16 onto the sheet P at the secondary transfer nip. Specifically, the yellow, cyan, magenta, and black toner images constructing the composite, full color toner image are collectively transferred onto the sheet P.

The sheet P bearing the full color toner image is conveyed to the fixing device 7, in which the fixing belt 22 and the pressure roller 23 fix the toner image onto the sheet P under heat and pressure. The sheet P bearing the fixed toner image is separated from the fixing belt 22 and conveyed by the conveyance roller pair to the sheet ejector 8. The ejection roller pair 24 of the sheet ejector 8 ejects the sheet P onto the output tray 25.

The above describes the image forming operation of the color image forming apparatus 1 to form the full color toner image on the sheet P serving as a recording medium. Alternatively, the image forming apparatus 1 may form a monochrome toner image by using any one of the four process units 9Y, 9C, 9M, and 9K, or may form a bicolor toner image or a tricolor toner image by using two or three of the process units 9Y, 9C, 9M, and 9K.

Figure 2:
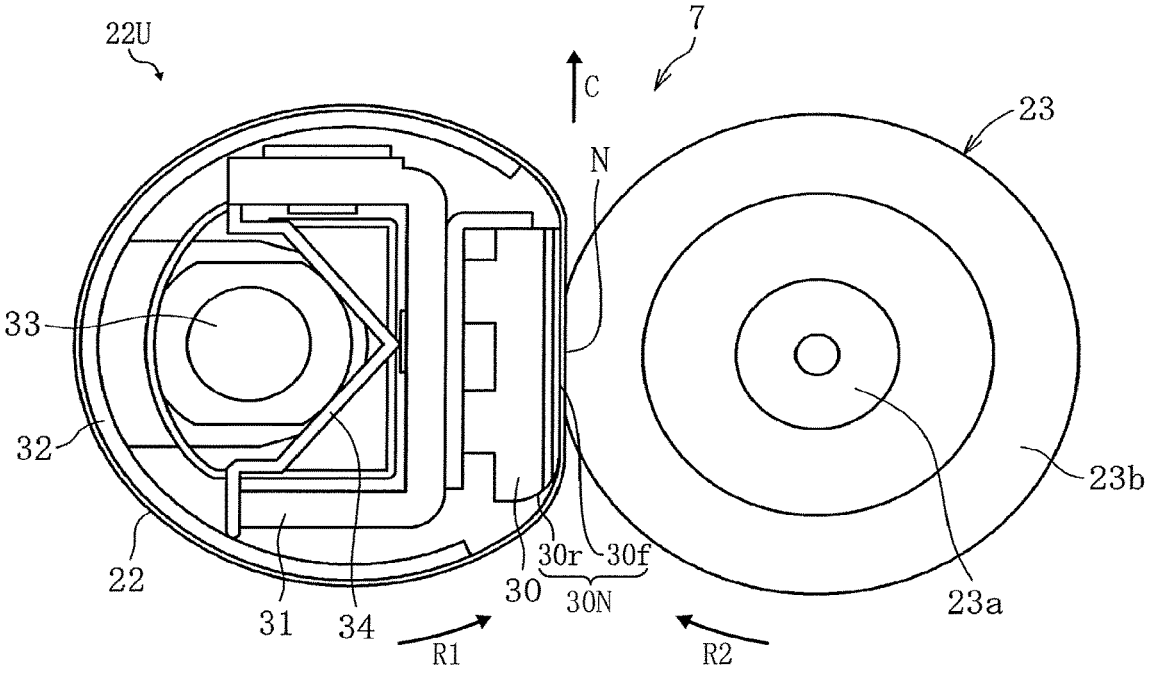
FIG. 2 is a schematic sectional view of a fixing device incorporated in the image forming apparatus of FIG. 1.

Referring now to FIG. 2, a detailed description is given of a configuration of the fixing device 7 incorporated in the image forming apparatus 1 described above.

FIG. 2 is a schematic sectional view of the fixing device 7.

As illustrated in FIG. 2, the fixing device 7, which may be referred to as a fuser or a fusing unit, includes, e.g., the fixing belt 22 serving as a fixing rotator and the pressure roller 23 serving as a pressure rotator pressed against the fixing rotator. In the present embodiment, the pressure roller 23 is a rotator that is rotatable in a direction of rotation, which is, in this case, a rotation direction R2. The fixing belt 22 is an endless belt that contacts the rotator and rotates in a direction of rotation, which is, in this case, a rotation direction R1.

Inside a loop formed by the fixing belt 22, the fixing device 7 further includes, e.g., a nip formation pad 30, a support 31, a flange 32, a heater 33, and a reflector 34. The support 31 supports the nip formation pad 30. The flange 32 is disposed at each of opposed longitudinal or axial ends of the fixing belt 22. The reflector 34 reflects heat radiating from the heater 33. The fixing belt 22 and the components disposed inside the loop formed by the fixing belt 22, that is, the nip formation pad 30, the support 31, the flange 32, the heater 33, and the reflector 34, may constitute a belt unit 22U detachably coupled to the pressure roller 23.

The fixing belt 22 is an endless belt or film made of a metal material, such as nickel or stainless steel (e.g., steel use stainless or SUS), or a resin material such as polyimide.

The fixing belt 22 is constructed of a base layer and a release layer. The release layer, as an outer surface layer of the fixing belt 22, is made of tetrafluoroethylene-perfluoroalkylvinylether copolymer (PFA), polytetrafluoroethylene (PTFE), or the like to facilitate separation of toner of the toner image on the sheet P from the fixing belt 22.

Optionally, an elastic layer made of, e.g., silicone rubber may be interposed between the base layer and the release layer.

If the fixing belt 22 does not incorporate the elastic layer, the fixing belt 22 has a decreased thermal capacity that improves fixing property of being heated quickly to a desired fixing temperature at which the toner image is fixed onto the sheet P. However, as the fixing belt 22 and the pressure roller 23 sandwich and press the unfixed toner image onto the sheet P, slight surface asperities in the fixing belt 22 may be transferred onto the toner image on the sheet P, resulting in variation in gloss of the solid toner image that may appear as an orange peel image on the sheet P. To address this circumstance, the elastic layer, made of, e.g., silicone rubber, may be provided with a thickness not smaller than about 100 μm. As the elastic layer deforms, the elastic layer absorbs the slight surface asperities in the fixing belt 22, thereby preventing formation of the orange peel image on the sheet P.

The nip formation pad 30 is disposed in contact with the inner circumferential surface of the fixing belt 22 to form a fixing nip N between the fixing belt 22 and the pressure roller 23. In other words, the nip formation pad 30 contacts the inner circumferential surface of the fixing belt 22 to form the fixing nip N between the fixing belt 22 and the pressure roller 23 that presses the fixing belt 22 against the nip formation pad 30.

The nip formation pad 30 has a nip formation surface 30N on a front side facing the fixing nip N. An upstream side of the nip formation surface 30N in the sheet conveyance direction C is curved, thereby being apart from the fixing belt 22. In other words, the nip formation surface 30N includes a curved face 30*r* upstream from the fixing nip N in the sheet conveyance direction C. The curved face 30*r* of nip formation surface 30N separates the nip formation pad 30 from the fixing belt 22, thereby preventing generation of a great friction force between the fixing belt 22 and the nip formation pad 30, and further preventing damage to the fixing belt 22 by friction between the fixing belt 22 and the nip formation pad 30. Except the curved face 30*r*, the nip formation surface 30N is plane parallel to the sheet conveyance direction C. In other words, the nip formation surface has a planar face 30*f* in addition to the curved face 30*r*. In the present embodiment, the nip formation surface 30N has the curved face 30*r* upstream and the planar face 30*f* downstream in the sheet conveyance direction C. The planar face 30*f* of the nip formation surface 30N contacts the fixing belt 22, thereby forming the fixing nip N between the fixing belt 22 and the pressure roller 23.

The support 31 contacts a back side of the nip formation pad 30 to support the nip formation pad 30 from the back side of the nip formation pad 30. Accordingly, when the nip formation pad 30 receives pressure from the pressure roller 23, the support 31 prevents the nip formation pad 30 from being bent by such pressure, thereby maintaining a uniform width of the fixing nip N across the axial direction of the fixing belt 22.

The flange 32 contacts the inner circumferential surface of the fixing belt 22 at each of the opposed axial ends of the fixing belt 22 to hold the fixing belt 22. As illustrated in FIG. 2, the flange 32 guides each of the opposed axial ends of the fixing belt 22 in a circumferential span of the fixing belt 22, other than a nip span thereof located at the fixing nip N. At the fixing nip N, the fixing belt 22 rotates while being sandwiched by the nip formation pad 30 and the pressure roller 23. On the other hand, at a location other than the fixing nip N, the fixing belt 22 rotates while being guided by the flange 32. The flange 32 also supports each of opposed longitudinal ends of the support 31. Thus, the support 31 is positioned with respect to the flange 32.

In the present embodiment, the heater 33 is a halogen heater. The heater 33, disposed inside the loop formed by the fixing belt 22, heats the inner circumferential surface of the fixing belt 22 by radiation heat. The heater 33 is not limited to a halogen heater. Alternatively, the heater 33 may be an induction heater (IH), a resistive heat generator, a carbon heater, or the like.

The reflector 34 is interposed between the heater 33 and the support 31 to reflect the radiation heat from the heater 33 toward the fixing belt 22, thereby preventing transmission of the radiation heat to the support 31, and enhancing heating efficiency of the heater 33 to heat the fixing belt 22. Alternatively, instead of the reflector 34, an interior surface of the support 31 facing the heater 33 may be insulated or given a mirror finish to reflect the radiation heat from the heater 33 toward the fixing belt 22.

The pressure roller 23 includes a cored bar 23*a* and an elastic layer 23*b* provided on an outer circumferential surface side of the cored bar 23*a*. The pressure roller 23 further includes a release layer as an outer surface of the pressure roller 23. The release layer is made of, e.g., PFA or PTFE to facilitate separation of the sheet P from the pressure roller 23. As a driver, such as a motor, drives and rotates the pressure roller 23, a driving force of the driver is transmitted from the pressure roller 23 to the fixing belt 22 that is in pressure contact with the pressure roller 23 at the fixing nip N, thereby rotating the fixing belt 22.

A biasing mechanism, such as a spring, presses the pressure roller 23 against the fixing belt 22, thereby pressing and elastically deforming the elastic layer 23*b* of the pressure roller 23. Thus, the fixing nip N is formed between the pressure roller 23 and the fixing belt 22.

The pressure roller 23 may be either a solid roller or a hollow roller. If the pressure roller 23 is a hollow roller, optionally, a heater may be disposed inside the pressure roller 23. The elastic layer 23*b* of the pressure roller 23 may be made of solid rubber. Alternatively, if no heater is situated inside the pressure roller 23, the elastic layer 23*b* may be made of sponge rubber. The sponge rubber is preferable to the solid rubber because the sponge rubber has enhanced thermal insulation that draws less heat from the fixing belt 22.

Typically, to reduce friction between a nip formation pad and a fixing belt, a fibroid slide aid holding a lubricant may be often disposed therebetween. The lubricant thus held passes through holes formed inside the fibroid slide aid and reaches a slide face of the fibroid slide aid over which the fixing belt slides. Thus, the lubricant is supplied to the slide face of the fibroid slide aid, thereby reducing a frictional force generated between the nip formation pad and the fixing belt.

However, as the fixing belt slides over the fibroid slide aid, the slide face of the fibroid slide aid is worn or deformed. Such wear or deformation of the slide face of the fibroid slide aid may crush and damage the holes on a slide face side, hampering the supply of the lubricant to the slide face of the fibroid slide aid. In short, the frictional force loaded on the slide face may be reduced hardly over a long period of time.

Hence, according to the present embodiment, the fixing device includes a nip formation pad that supplies a lubricant to a slide face of the nip formation pad over which the fixing belt slides over, while reducing friction between the nip formation pad and the fixing belt, over a long period of time.

Specifically, the nip formation pad includes a lubricant holding layer that holds a lubricant and an abrasion-resistant slide layer including through holes. The lubricant is supplied from the lubricant holding layer to the slide face via the through holes of the slide layer. The abrasion-resistant slide layer provided on a slide face side of the nip formation pad suppresses crushing of the through holes on the slide face side that may be caused by friction between the nip formation pad and the fixing belt. Accordingly, the nip formation pad can supply the lubricant to the slide face of the nip formation pad over which the fixing belt slides, while reducing friction between the nip formation pad and the fixing belt, over a long period of time.

Figure 3:
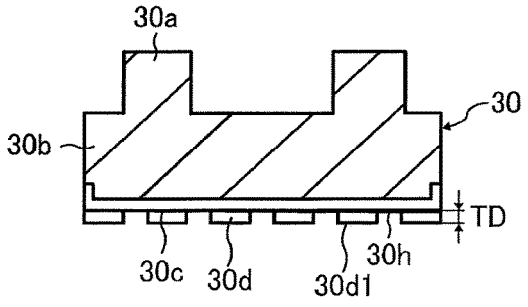
FIG. 3 is a schematic sectional view of a nip formation pad incorporated in the fixing device of FIG. 2.

Referring now to FIG. 3, a description is given of a layer structure of the nip formation pad 30 incorporated in the fixing device 7 described above.

FIG. 3 is a schematic sectional view of the nip formation pad 30.

Note that FIG. 3 and FIGS. 4A through 4F, referred later, illustrate an example of the nip formation pad 30 having a planar nip formation surface that faces the fixing nip N. According to the embodiments of the present disclosure, the nip formation pad 30 may have, e.g., a partly curved nip formation surface (i.e., nip formation surface 30N) as illustrated in FIG. 2 or a planar nip formation surface as illustrated in FIG. 3. That is, the nip formation pad has a shape changeable as appropriate to a required performance of the nip formation pad.

As illustrated in FIG. 3, the nip formation pad 30 is constructed of three layers, namely, a base layer 30*b*, a lubricant holding layer 30*c*, and a slide layer 30*d*, from the back side of the nip formation pad 30. The base layer 30*b* is provided with a plurality of projections 30*a* projecting toward the support 31. That is, the base layer 30*b* is disposed away from the fixing belt 22 and located on the back side of the nip formation pad 30 near the support 31 as illustrated in FIG. 2. In short, the slide layer 30*d* rests on the lubricant holding layer 30*c*. The lubricant holding layer 30*c* rests on the base layer 30*b*.

The base layer 30*b* is a layer that supports a load received from the pressure roller 23 illustrated in FIG. 2. The base layer 30*b* is made of an inorganic material or an organic material having sufficient pressure resistance and heat resistance to withstand ambient temperature around the nip formation pad 30 during operation of the fixing device 7. For example, the base layer 30*b* may be made of an inorganic material such as ceramic, glass, or aluminum, rubber such as silicone rubber or fluororubber, fluororesin such as PTFE, PFA, ethylene tetrafluoroethylene (ETFE), or tetrafluoroethylene hexafluoropropylene (FEP), resin such as polyimide (PI), polyamide imide (PAI), polyphenylene sulfide (PPS), polyether ether ketone (PEEK), liquid crystal plastic or liquid crystal polymer (LCP), phenolic resin, nylon, or aramid, or a combination thereof.

In particular, in the fixing device 7 in which the nip formation pad 30 is disposed near the fixing nip N, if the base layer 30*b* is made of a resin material, the resin material preferably has a noncombustibility conforming to a rating not lower than V-0 of UL-94 Standard released by Underwriters Laboratories Inc., a relative thermal index (RTI) not lower than about 100° C., and a heat deflection temperature not lower than about 260° C. Note that the RTI is a temperature index of thermotropic aging according to Underwriters Laboratories Inc. (UL) Standards, specifying the temperature at which electrical characteristics and mechanical characteristics can retain half or greater than original characteristics under exposure for a long period of time. The heat deflection temperature is measured according to Japanese Industrial Standards (JIS) K 7191. In the present embodiment, the base layer 30*b* is made of a liquid crystal polymer.

As illustrated in FIG. 3, the base layer 30*b* includes the projections 30*a* projecting toward the support 31. The projections 30*a* are disposed at predetermined intervals in line in a longitudinal direction of the nip formation pad 30. Note that the longitudinal direction of the nip formation pad 30 is parallel to the axial direction of the fixing belt 22 and perpendicular to the sheet conveyance direction C. In the present embodiment illustrated in FIG. 3, the projections 30*a* are aligned in two lines on an upstream side and a downstream side (i.e., left and right sides in FIG. 3), respectively, in the sheet conveyance direction C.

The lubricant holding layer 30*c* is interposed between the base layer 30*b* and the slide layer 30*d*. The lubricant holding layer 30*c* holds the lubricant inside the lubricant holding layer 30*c* and supplies the lubricant to the adjacent slide layer 30*d*.

The lubricant holding layer 30*c* is, e.g., a woven fabric made of polyphenylene sulfide (PPS) resin fiber having good lubricant holding characteristics, aramid fiber, nylon fiber, or the like. Alternatively, the lubricant holding layer 30*c* may be a nonwoven fabric impregnated with a lubricant using, e.g., silicone oil or fluorine oil as a base oil. In the present embodiment, the lubricant holding layer 30*c* is made of the PPS resin fiber.

The slide layer 30*d* is an abrasion-resistant layer that contacts the fixing belt 22. In other words, the fixing belt 22 slides over the slide layer 30*d* of the nip formation pad 30 that withstands abrasion caused by friction between the slide layer 30*d* and the fixing belt 22. The slide layer 30*d* has a porous structure including a large number of through holes 30*h* that go all the way through the slide layer 30*d* from a lubricant holding layer 30*c* side toward a slide face 30*d*1 side. A slide face 30*d*1 of the slide layer 30*d* contacts the outer circumferential surface of the fixing belt 22. In short, the slide layer 30*d* has a porous structure including a plurality of through holes 30*h* in a thickness direction TD of the slide layer 30*d*. The lubricant supplied from the lubricant holding layer 30*c* to the slide layer 30*d* seeps into the slide face 30*d*1 via the through holes 30*h* of the slide layer 30*d*. With the lubricant, the fixing belt 22 smoothly slides over the nip formation pad 30. Thus, the lubricant supplied from the lubricant holding layer 30*c* to the slide face 30*d*1 enhances the wear resistance or abrasion resistance of the slide face 30*d*1 of the nip formation pad 30.

To maintain a given abrasion resistance against sliding of the fixing belt 22, the slide layer 30*d* preferably has a thickness not smaller than about 15 μm and a pencil hardness not lower than H. Note that the pencil hardness is a value measured by a pencil hardness test prescribed in JIS K 5600-5-4. In addition, to enhance smooth rotation of the fixing belt 22 and to maintain the abrasion resistance of the slide layer 30*d*, a preferable coefficient of static friction is not greater than about 0.3 between the slide face 30*d*1 of the nip formation pad 30 and the outer circumferential surface of the fixing belt 22 while the slide face 30*d*1 is filled with the lubricant. Further, the slide layer 30*d* has a given heat resistance to withstand frictional heat generated when the fixing belt 22 slides over the slide layer 30*d* and a relatively high temperature of the fixing belt 22 when the fixing belt 22 reaches the fixing temperature.

In consideration of the above, the slide layer 30*d* may be made of, e.g., ceramic, PTFE, PFA, or a combination of these materials. In the present embodiment, the slide layer 30*d* is made of a coating material using PTFE.

Referring now to FIGS. 4A through 4F, a description is given of how the nip formation pad 30 is molded.

Figure 4A:
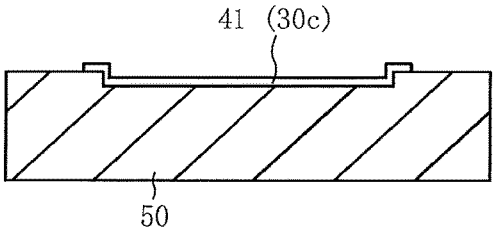
FIG. 4A is a partial sectional view of the nip formation pad, illustrating a first molding stage.
Figure 4B:
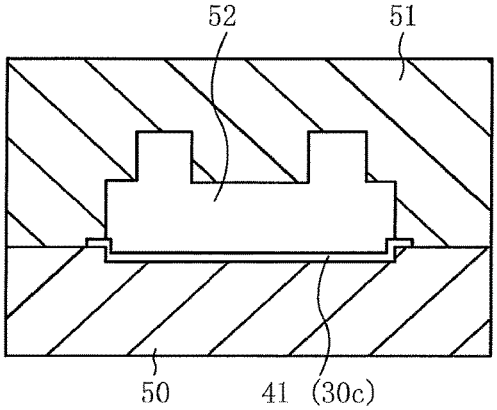
FIG. 4B is a partial sectional view of the nip formation pad, illustrating a second molding stage.
Figure 4C:
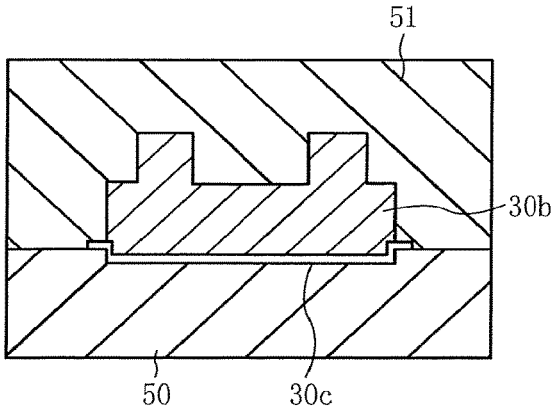
FIG. 4C is a partial sectional view of the nip formation pad, illustrating a third molding stage.
Figure 4D:
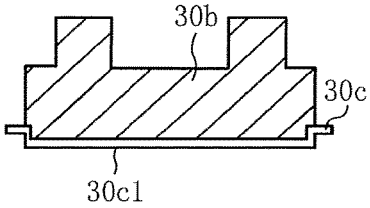
FIG. 4D is a partial sectional view of the nip formation pad, illustrating a fourth molding stage.
Figure 4E:
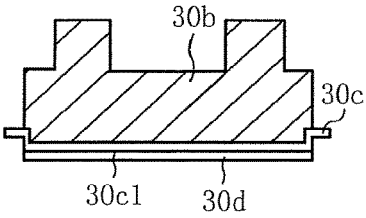
FIG. 4E is a sectional view of the nip formation pad, illustrating a fifth molding stage.
Figure 4F:
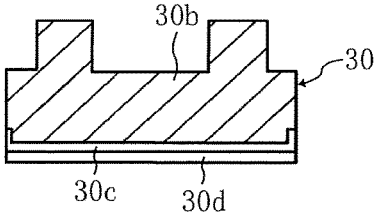
FIG. 4F is a sectional view of the nip formation pad, illustrating a final shape thereof.

FIG. 4A is a partial sectional view of the nip formation pad 30, illustrating a first molding stage. FIG. 4B is a partial sectional view of the nip formation pad 30, illustrating a second molding stage. FIG. 4C is a partial sectional view of the nip formation pad 30, illustrating a third molding stage. FIG. 4D is a partial sectional view of the nip formation pad 30, illustrating a fourth molding stage. FIG. 4E is a sectional view of the nip formation pad 30, illustrating a fifth molding stage. FIG. 4F is a sectional view of the nip formation pad 30, illustrating a final shape thereof.

First, as illustrated in FIG. 4A, a cloth material 41 forming the lubricant holding layer 30*c* is placed on a first mold 50, which is a mold on a slide face side of the nip formation pad 30. Then, as illustrated in FIG. 4B, the first mold 50 and a second mold 51, which is a mold on a back side of the nip formation pad 30, are joined together, thereby forming a cavity 52 therebetween to mold the base layer 30*b*.

In this state, as illustrated in FIG. 4C, the cavity 52 is filled with a material for forming the base layer 30*b* and cooled down to be solidified. Thus, the base layer 30*b* is molded. Then, the joined first and second molds 50 and 51 are released to take out a molded article. That is, as illustrated in FIG. 4D, an intermediate product is obtained including the base layer 30*b* and the lubricant holding layer 30*c* as an integral product.

Then, an opposite face 30*c*1 of the lubricant holding layer 30*c* facing away from the base layer 30*b* is spray coated, thereby forming the slide layer 30*d* on the opposite face 30*c*1 as illustrated in FIG. 4E. As the slide layer 30*d* is formed by spray coating, the slide layer 30*d* includes gaps between particles of a coating material. That is, the slide layer 30*d* has a porous structure including a large number of through holes 30*h*.

The slide layer 30*d* thus formed is then dried and solidified. Then, extra protruding portions of the solidified lubricant holding layer 30*c* are cut out to finally mold the nip formation pad 30. Thus, the nip formation pad 30 is formed as illustrated in FIG. 4F, with an integral three-layer structure constructed of the base layer 30*b*, the lubricant holding layer 30*c*, and the slide layer 30*d*.

In the present embodiment, the slide layer 30*d* is formed by spray coating as described above. Alternatively, for example, the slide layer 30*d* may be formed by laminating the intermediate product illustrated in FIG. 4D with a sheet-like material having a large number of through holes 30*h* in advance and applying thermocompression bonding to bond the sheet-like material and the intermediate product together.

Unlike the configuration of the nip formation pad 30 according to the present embodiment in which the nip formation pad 30 includes the slide layer 30*d* as an integral part thereof, an abrasion-resistant slide aid is typically provided separately from a nip formation pad. That is, fixing or securing parts and a working process are added to secure the slide aid to the nip formation pad, resulting in an increase in the number of parts and an increase in the number of assembling steps.

Figure 5:
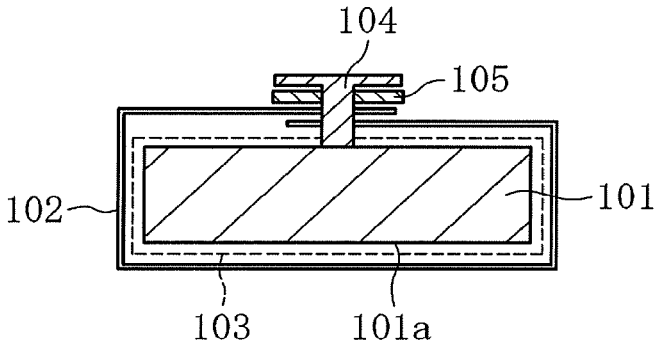
FIG. 5 is a schematic sectional view of a comparative nip formation pad.

Referring now to FIG. 5, a description is given of such a comparative nip formation pad having a configuration different from the configuration of the nip formation pad 30 of the present embodiment.

FIG. 5 is a schematic sectional view of a comparative nip formation pad 101.

As illustrated in FIG. 5, the comparative nip formation pad 101 has a slide face 101*a* and an abrasion-resistant slide sheet 102 disposed on the slide face 101*a* to enhance the abrasion resistance. In the example of FIG. 5, the slide sheet 102 is wound around an entire circumference of the nip formation pad 101. A double-sided tape 103 is interposed between the nip formation pad 101 and the slide sheet 102 to attach the slide sheet 102 to the nip formation pad 101. The slide sheet 102 has one end overlapping the other end on a back side of the nip formation pad 101, that is, an upper side of the nip formation pad 101 in FIG. 5. A screw 104 (i.e., external thread) passes through a plate 105 and an overlapped portion of the slide sheet 102 to engage with an internal thread of the nip formation pad 101. Thus, the overlapped portion of the slide sheet 102 is secured to the nip formation pad 101.

A comparative fixing device incorporating the comparative nip formation pad 101 includes, other than the nip formation pad 101, the slide sheet 102 for enhancing the abrasion resistance of a slide face side of the nip formation pad 101, securing members such as the double-sided tape 103 and the screw 104 for securing the slide sheet 102 to the nip formation pad 101, and the like. That is, the comparative fixing device includes a larger number of parts than the number of parts of the fixing device 7 of the present embodiment. In addition, the comparative fixing device needs an increased number of working steps to wind the slide sheet 102 around the nip formation pad 101, bond the nip formation pad 101 and the slide sheet 102 with the double-sided tape 103, and thereafter secure the slide sheet 102 to the nip formation pad 101 with the screw 104.

By contrast, in the present embodiment, the nip formation pad 30 has an integral, multilayer structure in which a plurality of layers is formed as an integral component. That is, the nip formation pad 30 obviates the need to provide securing parts or working processes, thereby reducing the number of parts and facilitating assembly. Note that "a plurality of layers is formed as an integral component" described above herein means that the slide layer 30*d*, the lubricant holding layer 30*c*, and the base layer 30*b* of the nip formation pad 30 are integrally molded, without being given additional securing members such as screws and tapes.

A description is given of advantages of the fixing device 7 according to the embodiments, examples, and variations described above.

As illustrated in FIG. 2, a fixing device (e.g., fixing device 7) includes a rotator (e.g., pressure roller 23), an endless belt (e.g., fixing belt 22), and a nip formation pad (e.g., nip formation pad 30). The rotator is rotatable in a direction of rotation (e.g., rotation direction R2). The endless belt contacts the rotator and rotates in a direction of rotation (e.g., rotation direction R1). The nip formation pad contacts an inner circumferential surface of the endless belt to form a fixing nip (e.g., fixing nip N) between the endless belt and the rotator that presses the endless belt against the nip formation pad. The nip formation pad includes a slide layer (e.g., slide layer 30*d*), a base layer (e.g., base layer 30*b*), and a lubricant holding layer (e.g., lubricant holding layer 30*c*). The slide layer contacts the endless belt. The base layer is disposed away from the endless belt. The lubricant holding layer is interposed between the slide layer and the base layer to hold a lubricant inside the lubricant holding layer and supply the lubricant to the slide layer. The slide layer has a porous structure including a plurality of through holes (e.g., through holes 30*h*) in a thickness direction (e.g., thickness direction TD) of the slide layer.

In short, the lubricant is supplied from the lubricant holding layer to a slide face of the nip formation pad via the through holes of the slide layer. The slide layer is an abrasion-resistant slide layer provided on a slide face side of the nip formation pad. The abrasion-resistant slide layer suppresses crushing of the through holes on the slide face side that may be caused by friction between the nip formation pad and the fixing belt.

Accordingly, the nip formation pad can supply the lubricant to the slide face of the nip formation pad over which the fixing belt slides, while reducing friction between the nip formation pad and the fixing belt, over a long period of time.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, the image forming apparatus according to the embodiments of the present disclosure is not limited to the color image forming apparatus 1 described above. Alternatively, the image forming apparatus may be a monochrome image forming apparatus that forms a monochrome image on a recording medium. In addition, the image forming apparatus according to the embodiments of the present disclosure may be, e.g., a copier, a facsimile machine, a printer, a multifunction peripheral (MFP) having at least two of copying, printing, scanning, facsimile, and plotter functions.

The fixing device according to the embodiments of the present disclosure is not limited to the fixing device 7 described above, which includes the fixing belt 22 as a fixing rotator and the pressure roller 23 as a pressure rotator. Alternatively, for example, the fixing device may include a fixing roller as a fixing rotator and an endless belt as a pressure rotator that presses against the fixing roller. That is, the fixing roller is a rotator that is rotatable in a direction of rotation. The pressure rotator is an endless belt that contacts the rotator and rotates in a direction of rotation. Alternatively, a fixing film, a fixing sleeve, or the like may be used as a fixing rotator.

Any one of the above-described operations may be performed in various other ways, for example, in an order different from that described above.

Further, any of the above-described devices or units can be implemented as a hardware apparatus, such as a special-purpose circuit or device, or as a hardware/software combination, such as a processor executing a software program.

What is claimed is:

1. A fixing device comprising:

a rotator rotatable in a direction of rotation;

an endless belt to contact the rotator and rotate in a direction of rotation; and a nip formation pad to contact an inner circumferential surface of the endless belt to form a fixing nip between the endless belt and the rotator, the rotator pressing the endless belt against the nip formation pad, the nip formation pad including:

a slide layer to contact the endless belt;

a base layer disposed away from the endless belt; and a lubricant holding layer interposed between the slide layer and the base layer to hold a lubricant inside the lubricant holding layer and supply the lubricant to the slide layer, the slide layer including a spray coated porous structure including a plurality of through holes in a thickness direction of the slide layer, and gaps between particles of a spray coated material of the spray coated porous structure form the plurality of through holes.

2. The fixing device according to claim 1, wherein the slide layer has an abrasion resistance.

3. The fixing device according to claim 1, wherein the slide layer, the base layer, and the lubricant holding layer of the nip formation pad are integrally molded.

4. The fixing device according to claim 1, wherein the slide layer has a thickness not smaller than 15 μm.

5. The fixing device according to claim 1, wherein the slide layer has a pencil hardness not lower than H.

6. The fixing device according to claim 1, wherein the slide layer has a slide face to contact the inner circumferential surface of the endless belt, and wherein a coefficient of static friction is not greater than 0.3 between the slide face of the slide layer and the inner circumferential surface of the endless belt.

7. The fixing device according to claim 1, wherein the base layer is made of a resin material having a relative thermal index not lower than 100° C. according to Underwriters Laboratories Inc. Standards.

8. The fixing device according to claim 1, wherein the base layer is made of a resin material having a noncombustibility conforming to a rating not lower than V-0 of UL-94 Standard.

9. The fixing device according to claim 1, wherein the base layer is made of a resin material having a heat deflection temperature not lower than 260° C.

10. The fixing device according to claim 1, wherein the nip formation pad has a nip formation surface facing the fixing nip, and wherein the nip formation surface includes a curved face upstream and a planar face downstream in a direction of conveyance of a recording medium.

11. The fixing device according to claim 1, wherein the lubricant holding layer includes a fabric.

12. The fixing device according to claim 11, wherein the fabric includes at least one bent end that is molded to a side surface of the base layer.

13. The fixing device according to claim 1, wherein the base layer includes at least one molded projection that projects away from the fixing nip and that is spaced apart from ends of the base layer in a sheet conveyance direction.

14. An image forming apparatus comprising:

an image forming device to form a toner image; and a fixing device to fix the toner image on a recording medium, the fixing device including:

a rotator rotatable in a direction of rotation;

an endless belt to contact the rotator and rotate in a direction of rotation; and a nip formation pad to contact an inner circumferential surface of the endless belt to form a fixing nip between the endless belt and the rotator, the rotator pressing the endless belt against the nip formation pad, the nip formation pad including:

a slide layer to contact the endless belt;

a base layer disposed away from the endless belt; and a lubricant holding layer interposed between the slide layer and the base layer to hold a lubricant inside the lubricant holding layer and supply the lubricant to the slide layer, the slide layer including a spray coated porous structure including a plurality of through holes in a thickness direction of the slide layer, and gaps between particles of a spray coated material of the spray coated porous structure form the plurality of through holes.

* * * * *